US006175700B1

(12) United States Patent
Miller et al.

(10) Patent No.: US 6,175,700 B1
(45) Date of Patent: Jan. 16, 2001

(54) INSERTING TEST PATTERNS IN LARGE PRINT JOBS

(75) Inventors: William G. Miller, Canandaigua; Patrick T. Igoe, Grand Island; Gregg A. Bonikowski, Rochester, all of NY (US)

(73) Assignee: Xerox Corporation, Rochester, NY (US)

( * ) Notice: Under 35 U.S.C. 154(b), the term of this patent shall be extended for 0 days.

(21) Appl. No.: 09/484,241

(22) Filed: Jan. 18, 2000

(51) Int. Cl.[7] ..... G03G 21/00
(52) U.S. Cl. ..... 399/72; 399/11
(58) Field of Search ..... 399/72, 87, 82, 399/9, 11; 271/287, 288, 298

(56) References Cited

U.S. PATENT DOCUMENTS 5,221,973 6/1993 Miller et al. .
5,619,307 * 4/1997 Machino et al. ..... 399/11
5,729,634 3/1998 Robinson .
5,748,221 5/1998 Castelli et al. .
6,034,711 * 3/2000 Trask et al. .

* cited by examiner

*Primary Examiner*—Richard Moses
(74) *Attorney, Agent, or Firm*—Banner & Witcoff, Ltd.

(57) ABSTRACT

A method to print images on media sheets prints test patterns in an interrupt mode while printing the main job in a regular mode. The method includes marking a first group of images on a corresponding first group of sheets, marking a test pattern on a first test pattern sheet, marking a second group of images on a corresponding second group of sheets, delivering the first test pattern sheet to a sample tray, and passing the first and second groups of sheets to a finishing module. In a varient, the first test pattern sheet follows the first group of sheets in a sequence, the second group of sheets follows the first test pattern sheet in a sequence, and the second group of images follows the first group of images in a sequence.

7 Claims, 2 Drawing Sheets

INSERTING TEST PATTERNS IN LARGE PRINT JOBS

BACKGROUND OF THE INVENTION

1. Field of the Invention

The present invention relates to diagnosing whether a xerographic machine is running within specification during large printing jobs. In particular, the invention relates to inserting periodic test patterns into a large production print job and separating the printed test pattern from the printed production print job before the printed production print job is bound.

2. Description Of Related Art

During the printing of long jobs, especially those with color-critical output, it is often desirable to view diagnostic test patterns. These patterns allow the press operator to ensure that the press is operating within specification and that output will match proofs or prints from other devices. This procedure is fairly straightforward in the world of offset presses. Diagnostic test strips are printed on the edges of press sheets. There are access points on the press that allow sheets to be retrieved during the printing process. These sheets can be measured to check the current performance of the press.

In digital production printing, multipage documents are being produced and delivered via closed paper paths to finishing devices that do not allow convenient access to printed output until the printing process is complete. Furthermore, in most cases, sheet-fed digital presses image onto a paper size equal to that of the desired document. Thus, there is no non-document area on the sheets on which to place diagnostic patterns.

SUMMARY OF THE INVENTION

It is an object to the present invention to provide a digital color document production system with comparable sampling functionality to that of a known press that prints test patterns at the edge of media sheets. It is a further object of the present invention to provide a digital color document production system with an interrupt separator to allow the periodic production of test patterns on non-document sheets during the production run that can be immediately accessed by the press operator.

These and other objects are achieved in a method to print images on media sheets that prints test patterns in an interrupt mode while printing the main job in a regular mode. The method includes marking a first group of images on a corresponding first group of sheets, marking a test pattern on a first test pattern sheet, marking a second group of images on a corresponding second group of sheets, delivering the first test pattern sheet to a sample tray, and passing the first and second groups of sheets to a finishing module. In a varient of the method, the first test pattern sheet follows the first group of sheets in a sequence, the second group of sheets follows the first test pattern sheet in a sequence, and the second group of images follows the first group of images in a sequence.

In an alternative embodiment, a printer includes a feeding module to feed a plurality of media sheets, a marking module to mark a test pattern and a plurality of print images on the plurality of media sheets fed from the feeding module, a separator to deliver sheets on which the test pattern has been marked to a sample tray, and a finishing module to receive sheets from the separator on which the plurality of print images has been marked.

BRIEF DESCRIPTION OF DRAWINGS

The invention will be described in detail in the following description of preferred embodiments with reference to the following figures wherein.

DETAILED DESCRIPTION OF PREFERRED EMBODIMENTS

A job interrupt mechanism is provided that allows the submission of diagnostic test print jobs by a front end (preferably a digital front end) during the processing of the primary job.

As the primary production run is being executed, status about progress is returned to the front end. Each time the appropriate number of document sheets or sets has been produced for the main production run, the front end submits a diagnostic test pattern job at an interrupt priority. The interrupt priority diagnostic test pattern job is printed and delivered to a sample tray. The press operator removes the diagnostic test sheets from the sample tray as they are produced and checks their quality visually or with measurement devices. If the quality is not acceptable, adjustments may be made to press controls or the print station may be paused for service.

Intervals for test pattern production are specified on a job-by-job or global basis by the press operator.

The production of retrievable test patterns during a production run allows the press operator to monitor press performance during long production runs. By identifying problems before the completion of a production run, the operator is able to avoid wasted time and materials.

In an exemplary scenario, four hundred copies of a 50 page job are to be produced (a total of 20,000 pages). The job is also being printed in other locations on similar presses. It is important that operators at each location keep their presses within specification such that output from the multiple printing locations will match. The press operator at this location would like to monitor the performance of the press by sending diagnostic test prints to the sample tray. The press operator decides that diagnostic prints produced every 10 copies of the job (i.e., every 500 printed pages) would be adequate to assess the performance of the printing process. Using job programming tools at the digital front end, the press operator indicates the interval at which the diagnostic test prints should be produced.

The digital front end produces the document assembly tree to be sent to the print station to direct production of the document. As this primary production run is being executed, status about progress is returned to the digital front end. Each time the appropriate number of document sets has been produced for the main production run, the digital front end would submit a diagnostic job at interrupt priority. Given the document copy count of 400 and the sampling interval of 10 copies, 40 interrupt diagnostic test pattern jobs would be submitted during the production run. The press operator removes the diagnostic sheets from the sample tray as they are produced and checks their quality.

Figure 1:
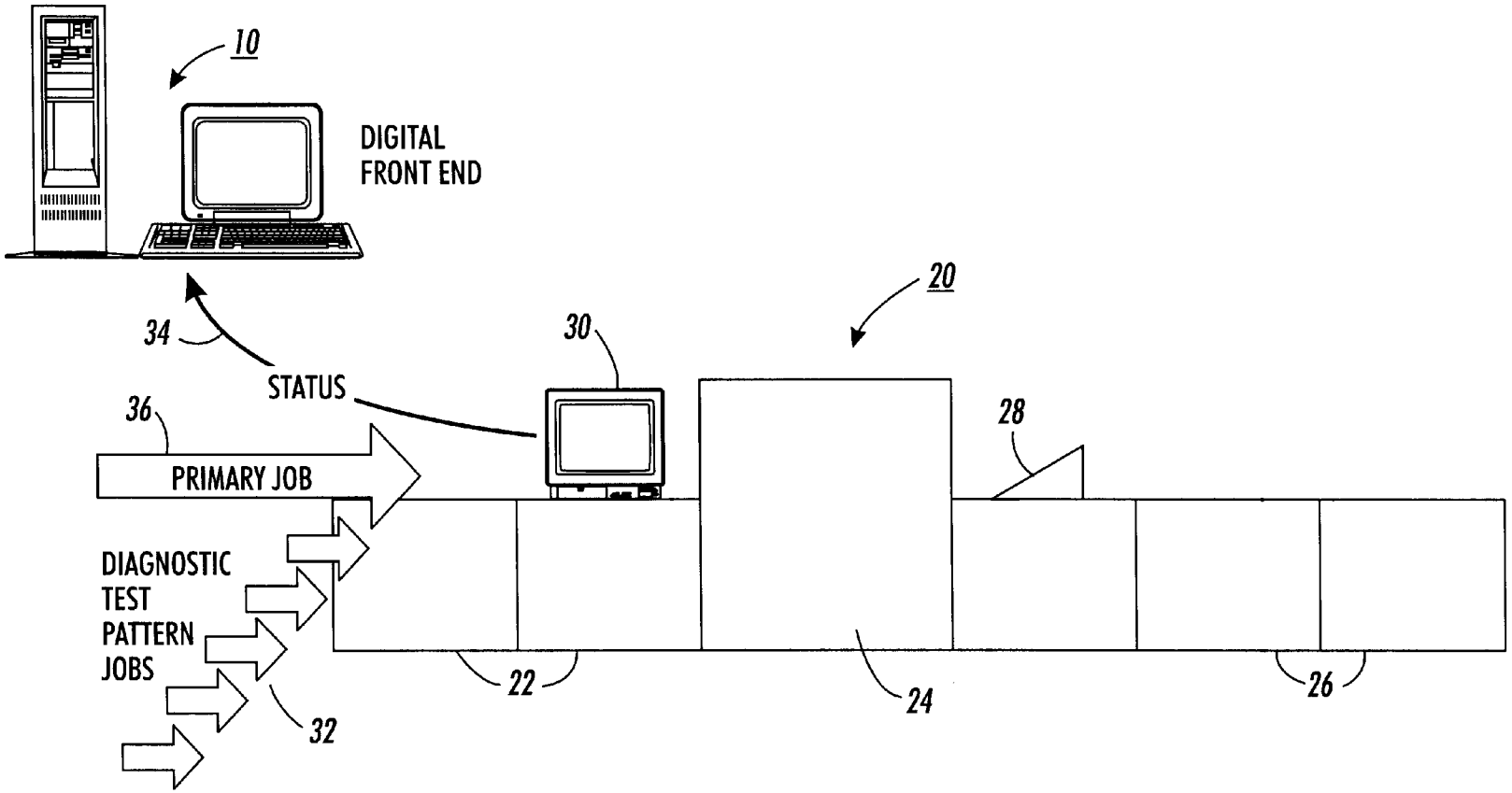
FIG. 1 is a schematic diagram of a printer according to the invention.

In FIG. 1, a printer includes front end controller 10 and printing system 20. Front end 10 is preferably a digital front end controller such a known type of personal computer or a custom made processor all programmed to operate as described herein. Printing system 10 includes one or more feeding modules 22, marking module 24 (also called a print engine) and one or more finishing modules 26. Marking module 24 preferably marks xerographically; however, other marking technologies may be used, for example by ink-jet marking or ionographically marking. Finishing module 26 receives marked sheets from marking module 24 and performs finishing processes on the sheets such as stacking, sorting, stapling or other binding operations.

Separator 28 is coupled between marking module 24 and finishing module 26. Separating module 28 provides a sample tray for a variety of functions. For example, when recovering from a printer jam, sheets within the printer are purged from the system and delivered to the sample tray where a press operator removes and discards the purged sheets. In the present invention, test pattern sheets are separated from sheets of the primary job in separator 28 and delivered to the sample tray.

Figure 2:
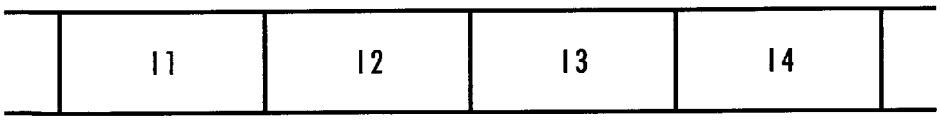
FIGS. 2 and 3 are formats of sequences of images to be printed.

Printing system 20 includes controller 30. Controller 30 controls feeding modules 22, marking module 24, finishing module 26, separator 28 and provides status information 34 to front end controller 10. Under control of controller 30, printing system 20 prints diagnostic test patterns 32 and a plurality of print images that constitutes primary job 36 on a plurality of media sheets. In FIG. 2, the primary job is regarded as including a plurality of groups of images to print (e.g., groups of images I1, I2, I3, I4).

Some printers that are sized for printing larger print jobs (e.g., over 1,000 sheets) are known to include an interrupt feature. When printing a larger print job, a scheduler of a printer will seek to maximize printing capacity through the machine. This is achieved by ensuring that the sheet feeder, the marker (or print engine) and the stacker (or finisher) are operating at a maximum speed consistent with coordination of the modules to maximize the processing of print media through the printer. In such a case, the stacker is stacking a sheet at the same time as the marker is marking the next sheet at the same time as the feeder is feeding the following sheet. To interrupt a large job in order to print a small job would ordinarily require stopping the large job and allowing the last fed sheet to be processed completely through the printer in order to start the interrupting small job. However, the interrupt feature (or interrupt mode) permits an interrupt job to be started before the large print job is processed through to the stacker module. The interrupt feature (or interrupt mode) is activated by pressing an associated button, and inserting the interrupt job into an alternative scanner. The output of the small interrupt job is taken from a sample tray or other alternative tray by the press machine operator. The main or large print job resumes and continues sending printed output to the stacker. In this way, some of the interrupt job processing overlaps the processing of the main job (but in different modules) to obtain greater efficiency. In the present invention, the press operator uses the interrupt mode to submit test patterns.

Figure 3:
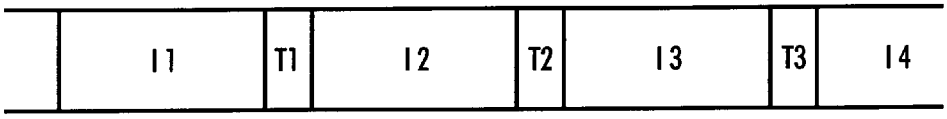
Figure 4:
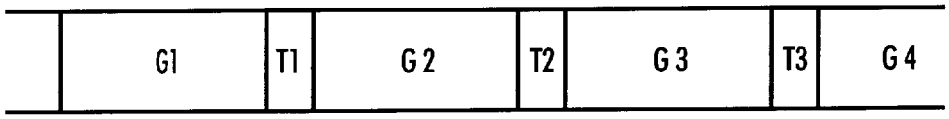
FIGS. 4 through 6 are formats of sequences of printed images.
Figure 5:
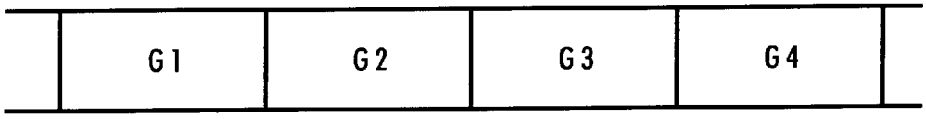
Figure 6:
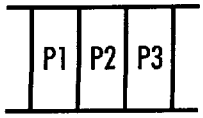

In operation, front end controller 10 of the present invention receives from a press operator a test pattern interval number which is then stored. The test pattern interval number represents the number of primary job sheets that are to be marked between test patterns. For example, the test pattern interval number might be set to 500 sheets. Controller 30 controls printing system 20 periodically insert a test pattern (e.g., T1, T2 or T3 of FIG. 3) in a sequence of the groups of images (e.g., groups of images I1, I2, I3 and I4 of FIG. 3). Controller 30 controls printing system 20 to mark first group of images I1 (see FIG. 3) of the plurality of print images on corresponding first group of sheets GI (see FIG. 4) of the plurality of media sheets. The number of sheets in the first group of sheets (e.g., 500) is defined to be the test pattern interval number. Then, controller 30 controls printing system 20 to insert and mark test pattern T1 on first test pattern sheet P1 of the plurality of media sheets (see FIGS. 3 and 4). First test pattern sheet P1 follows first group of sheets G1 in a sequence. Then, controller 30 controls printing system 20 to mark second group of images 12 (see FIG. 3) of the plurality of print images on corresponding second group of sheets G2 (see FIG. 4) of the plurality of media sheets. Second group of sheets G2 follows first test pattern sheet P1 in a sequence (see FIG. 4), and second group of images I2 follows first group of images I1 in a sequence (see FIG. 2). Then, controller 30 controls separator 28 to deliver first test pattern sheet P1 (see FIG. 6) to a sample tray and pass first and second groups of sheets G1 and G2 (FIG. 5) to finishing module 26.

Having described preferred embodiments of a novel method to periodically insert test patterns in a long xerographic printing job (which are intended to be illustrative and not limiting), it is noted that modifications and variations can be made by persons skilled in the art in light of the above teachings. It is therefore to be understood that changes may be made in the particular embodiments of the invention disclosed which are within the scope and spirit of the invention as defined by the appended claims.

Having thus described the invention with the details and particularity required by the patent laws, what is claimed and desired protected by Letters Patent is set forth in the appended claims.

What is claimed is:

1. A method to print a plurality of print images on a plurality of media sheets comprising steps of:

marking a first group of images of the plurality of print images on a corresponding first group of sheets of the plurality of media sheets;

marking a test pattern on a first test pattern sheet of the plurality of media sheets, the first test pattern sheet following the first group of sheets in a sequence;

marking a second group of images of the plurality of print images on a corresponding second group of sheets of the plurality of media sheets, the second group of sheets following the first test pattern sheet in a sequence, the second group of images following the first group of images in a sequence;

delivering the first test pattern sheet to a sample tray; and passing the first and second groups of sheets to a finishing module.

2. The method of claim 1, further comprising steps of:

marking the test pattern on a second test pattern sheet of the plurality of media sheets, the second test pattern sheet following the second group of sheets in a sequence; and marking a third group of images of the plurality of print images on a corresponding third group of sheets of the plurality of media sheets, the third group of sheets following the second test pattern sheet in a sequence, the third group of images following the second group of images in a sequence, wherein the step of delivering includes delivering the second test pattern sheet to the sample tray and the step of passing includes passing the third group of sheets the finishing module.

3. The method of claim 1, further comprising steps of:

storing a test pattern interval number; and controlling the steps of marking a first group and marking a second group so that a number of images in the first group of images is equal to the test pattern interval number and so that a number of images in the second group of images is equal to the test pattern interval number.

4. A printer comprising:

a feeding module to feed a plurality of media sheets;

a marking module to mark a test pattern and a plurality of print images on the plurality of media sheets fed from the feeding module;

a separator to deliver sheets on which the test pattern has been marked to a sample tray; and a finishing module to receive sheets from the separator on which the plurality of print images has been marked.

5. The printer of claim 4, further comprising a controller to control the marking module to:

mark a first group of images of the plurality of print images on a corresponding first group of sheets of the plurality of media sheets, the separator passing the first group of sheets to the finishing module;

mark the test pattern on a first test pattern sheet of the plurality of media sheets, the first test pattern sheet following the first group of sheets in a sequence, the separator delivering the first test pattern sheet to the sample tray;

mark a second group of images of the plurality of print images on a corresponding second group of sheets of the plurality of media sheets, the second group of sheets following the first test pattern sheet in a sequence, the second group of images following the first group of images in a sequence, the separator delivering the second group of sheets to the finishing module.

6. The printer of claim 5, wherein the controller further controls the marking module to:

mark the test pattern on a second test pattern sheet of the plurality of media sheets, the second test pattern sheet following the second group of sheets in a sequence, the separator delivering the second test pattern sheet to the sample tray; and mark a third group of images of the plurality of print images on a corresponding third group of sheets of the plurality of media sheets, the third group of sheets following the second test pattern sheet in a sequence, the third group of images following the second group of images in a sequence, the separator passing the third group of sheets to the finishing module.

7. The printer of claim 4, further comprising a controller to store a test pattern interval number and to control the marking module to mark the first and second groups so that a number of images in the first group of images is equal to the test pattern interval number and so that a number of images in the second group of images is equal to the test pattern interval number.

* * * * *